US006052924A

United States Patent [19]

Sabat

[11] Patent Number: 6,052,924

[45] Date of Patent: Apr. 25, 2000

[54] VARIABLE WEIGHT ATHLETIC SHOE

[76] Inventor: Jack M. Sabat, 140 Hot Springs Rd., Montecito, Calif. 93108

[21] Appl. No.: 09/170,245

[22] Filed: Oct. 13, 1998

[51] Int. Cl.[7] ..... A63B 21/065; A63B 21/06; A43B 5/06

[52] U.S. Cl. ..... 36/132; 36/136; 482/79; 482/93; 482/105

[58] Field of Search ..... 36/50.5, 132, 136; 24/68 R, 69 R, 70 SK, 70 ST, 68 SK; 482/79, 80, 93, 98, 105

[56] References Cited

U.S. PATENT DOCUMENTS

| | | | |
|---|---|---|---|
| 3,114,982 | 12/1963 | McGowan | 36/132 |
| 3,306,610 | 2/1967 | Biggs et al. | 36/132 |
| 3,334,898 | 8/1967 | McCrory et al. | 36/136 |
| 3,662,435 | 5/1972 | Allsop | 24/68 SK |
| 4,304,055 | 12/1981 | Hanson | 36/50.5 |
| 4,310,951 | 1/1982 | Riedel | 24/68 SK |
| 4,395,801 | 8/1983 | Gabrielli | 24/70 SK |
| 4,458,432 | 7/1984 | Stempski | 36/132 |
| 4,712,319 | 12/1987 | Goria | 36/136 |
| 4,777,743 | 10/1988 | Roehrig, Jr. | 36/132 |
| 5,226,246 | 7/1993 | Soo | 36/50.5 |
| 5,407,413 | 4/1995 | Kupferman | 482/93 |
| 5,530,997 | 7/1996 | Tessari | 24/68 SK |
| 5,632,709 | 5/1997 | Walsh | 482/79 |
| 5,728,032 | 3/1998 | Glass | 36/132 |
| 5,779,259 | 7/1998 | Lin | 24/68 SK |
| 5,845,371 | 12/1998 | Chen | 24/68 SK |
| 5,852,852 | 12/1998 | Rigal | 24/68 SK |
| 5,887,318 | 3/1999 | Nicoletti | 24/70 SK |
| 5,893,223 | 4/1999 | Glass | 36/132 |
| 5,909,850 | 6/1999 | Cavasin et al. | 24/70 SK |
| 5,910,070 | 6/1999 | Henry et al. | 482/93 |

*Primary Examiner*—Paul T. Sewell
*Assistant Examiner*—Anthony Stashick
*Attorney, Agent, or Firm*—Beehler & Pavitt; David A. Belasco; William H. Pavitt, Jr.

[57] ABSTRACT

A variable weight athletic shoe is described. The athletic shoe may be removably fitted with training weights of varying heaviness or the weights may be left off entirely without damaging the aesthetic appeal or functional aspects of the shoe. Weights of various sizes are quickly and securely coupled to the rear portion of the heel-enclosing section of the shoe with several types of attachment clips and latches. In other variants of the invention, shoe weights are removably attached within cavities in the heel or arch sections of the shoe sole. Weights may also be attached across the instep of the athletic shoe. The shoe weights may be covered in various protective and decorative coverings and may contain lightening holes to achieve the desired weight in a given size.

18 Claims, 5 Drawing Sheets

Fig. 12
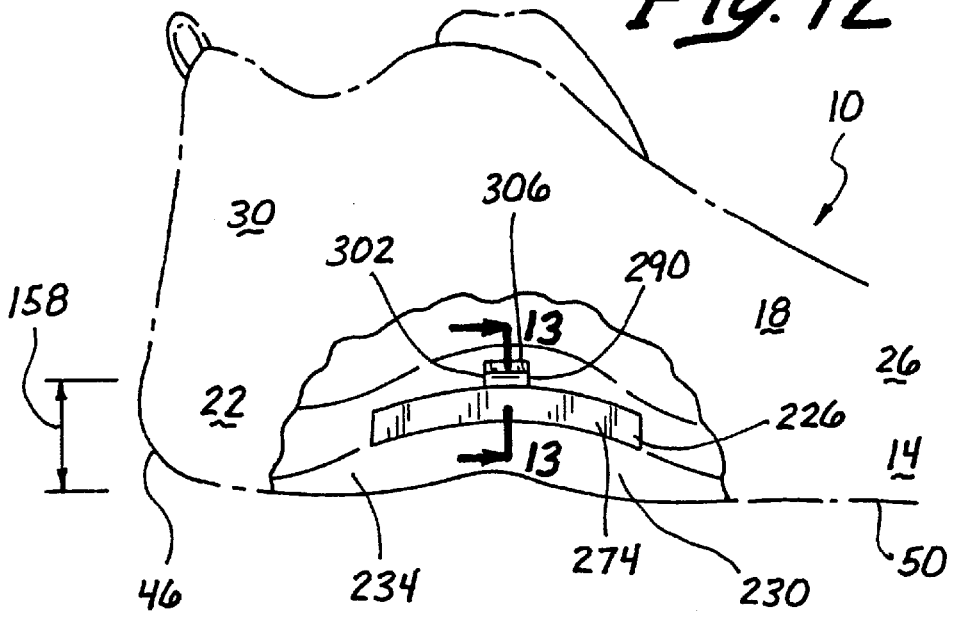
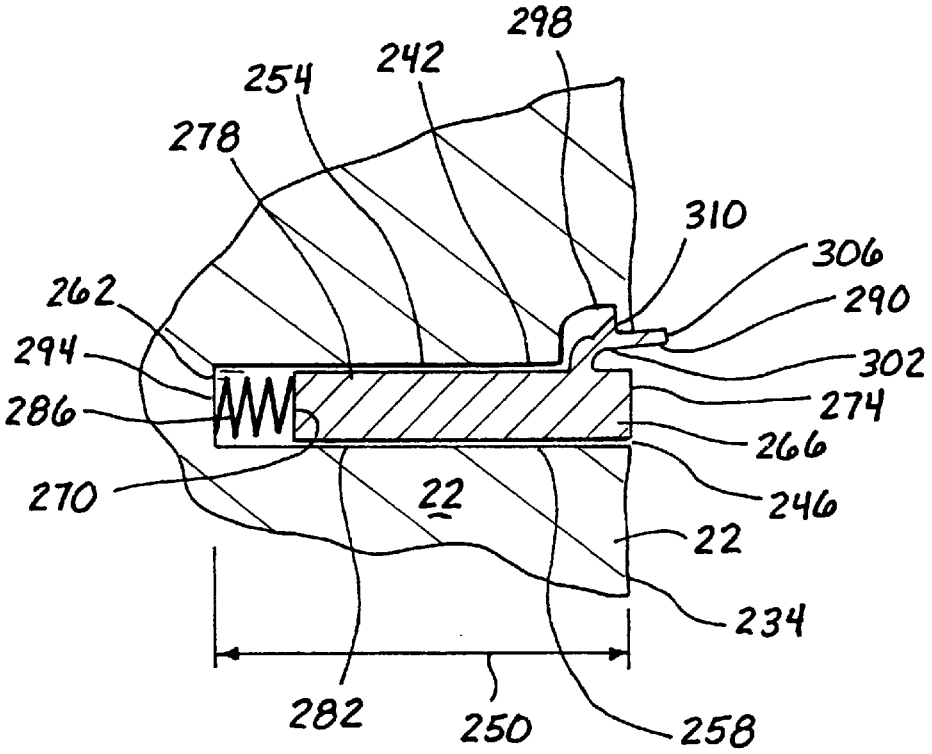
Fig. 13

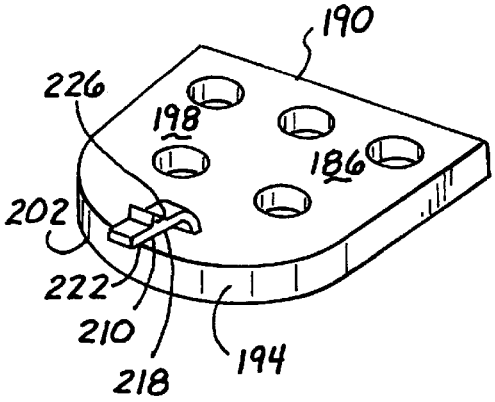
Fig. 11
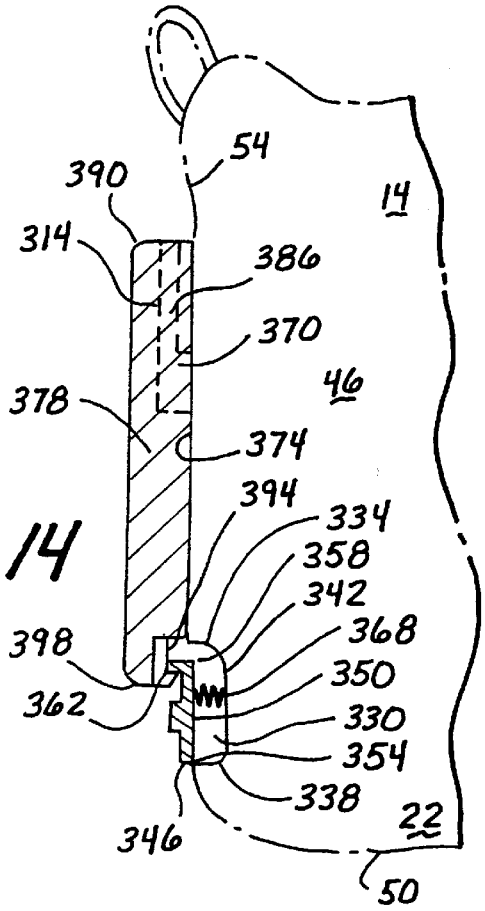
Fig. 14
Fig. 15
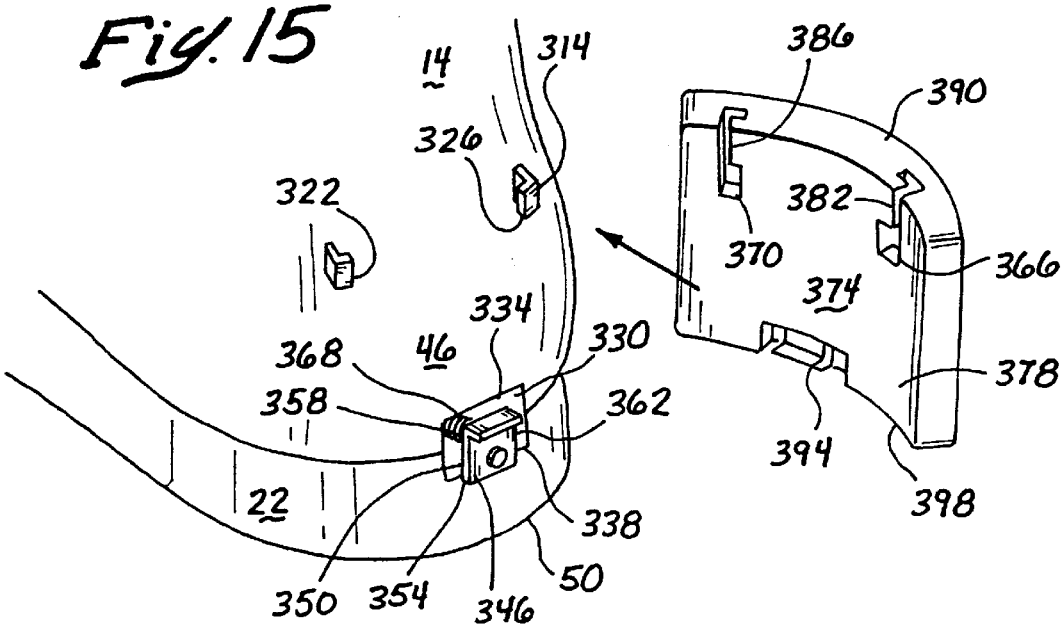

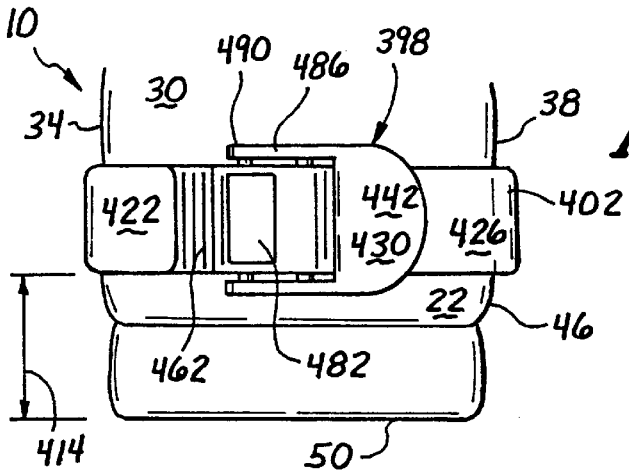
Fig. 16
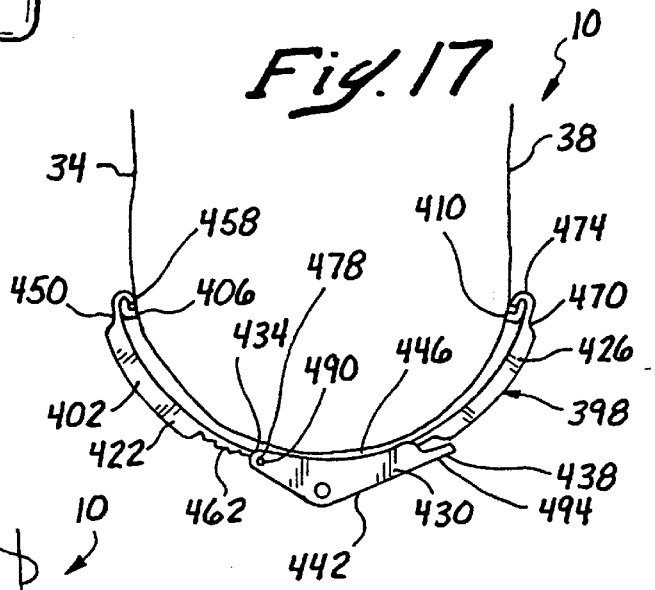
Fig. 17
Fig. 18
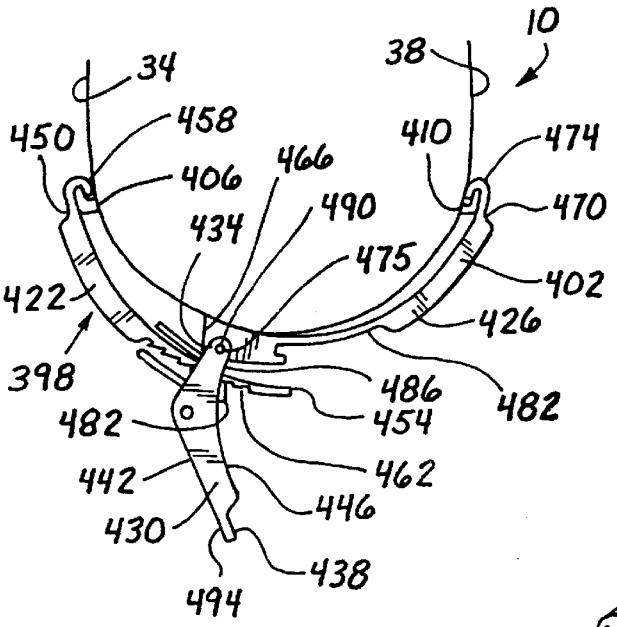
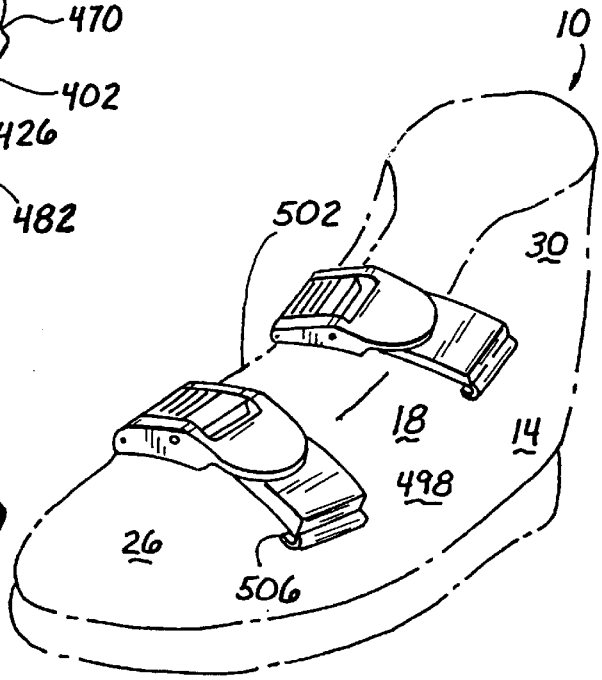
Fig. 19

VARIABLE WEIGHT ATHLETIC SHOE

FIELD OF INVENTION

The invention pertains to field of athletic shoes. More particularly, the invention relates to athletic shoes designed to accept a variable amount of additional weight for purposes of training and exercise.

BACKGROUND OF THE INVENTION

Various shoe designs have been developed which include weights for purposes of providing additional exercise or weight training to the wearer of the shoe. U.S. Pat. No. 5,231,776 issued to Wagner incorporates a plurality of small metallic spheres entrapped in a lattice grid matrix molded to the sole. U.S. Pat. Nos. 5,638,613 and 4,709,921 issued to Williams and Valuikas et al., respectively, utilize flattened weights integrated into the soles of shoes, as does U.S. Pat. No. 3,109,245, issued to R. P. Glynn. More advanced shoes have included various means to add varying amounts of weight to the shoe. U.S. Pat. No. 4,777,743 issued to Roehrig, Jr. uses one or more weighted fastening straps disposed about the upper ankle portion of the shoe top. U.S. Pat. No. 4,686,781, issued to Bury includes a chamber in the sole of the shoe designed to accommodate lead shot or similar weighting material. U.S. Pat. Nos. 3,114,982 and 4,458,432, issued to McGowan, and Stempski, respectively, incorporate pockets to hold shoe weights.

Prior art designs for weighted shoes either do not provide a capability to remove or vary the weight attached to the shoe or provide only a limited capacity to vary the weight. Some of the designs include external weight pockets that provide relatively unbalanced weighting and do not integrate smoothly with the appearance of the shoe. Some of the designs allow the shoe weights to shift within cavities in the shoe, increasing the shoe's instability to the wearer.

It is an objective of the present invention to provide for variable weighting of the shoe. It is a further objective to allow the wearer to remove the weight from the shoe entirely without interfering with the structural integrity of the shoe. It is a still further objective of the invention to have the weighting capability integrate smoothly with the appearance of the shoe. It is yet a further objective to permit the wearer to change the weighting of the shoe without the use of external tools.

While some of the objectives of the present invention are disclosed in the prior art, none of the inventions found include all of the requirements identified.

SUMMARY OF THE INVENTION

The present invention addresses all of the deficiencies of prior art weighted shoe inventions and satisfies all of the objectives described above. A variable weight athletic shoe may be constructed from the following components. An athletic shoe having an upper portion and a resilient sole portion is provided. The upper portion has a forefoot enclosing section and a heel-enclosing section. The heel-enclosing section has a first side and a second side. The sole portion has a forward end, an after end and a bottom surface. The after end extends upwardly from the bottom surface to a top edge and upon the heel-enclosing section of the upper portion.

A removable shoe weight is provided. The weight is formed of a resilient material and is shaped to conform to the after end on the sole portion. The weight has an inner surface, an outer surface, a top edge and a bottom edge.

Means are provided for removably attaching the weight to the after end of the sole portion.

In a variation of the invention, the means for removably attaching the weight to the after end of the sole portion further comprises a cavity located between the bottom surface and the top edge of the after end of the sole portion of the athletic shoe. The cavity has an upper edge, a lower edge and a back portion and is sized, shaped and disposed to receive the removable shoe weight.

A lower receiving notch located at the lower edge of the cavity and an upper receiving notch located at the upper edge of the cavity are provided. A projecting tab is fixedly attached to the bottom edge of the weight. The tab is sized, shaped and located to removably engage the lower receiving notch of the cavity.

A resilient latch is fixedly attached to the top edge of the weight. The latch is sized, shaped and located to releasably engage the upper receiving notch of the cavity. In use, the projecting tab is inserted into the lower receiving notch and the weight is tilted upwardly toward the athletic shoe. The resilient latch is pressed downwardly toward the projecting tab, and the weight is pressed into the cavity. The resilient latch is released to engage the upper receiving notch. Thus the weight is removably attached to the athletic shoe.

In another variation of the invention, a plurality of weights of varying heaviness, formed to attach to the cavity of the athletic shoe, are provided. In still another variation, the weights are encased in a covering material selected to protect the weight from corrosive forces and enhance the appearance of the shoe.

In yet another variation of the invention, the means for removably attaching the weight to the after end of the sole portion further comprises a cavity located between the bottom surface and the top edge of the after end of the sole portion of the athletic shoe. The cavity has an upper edge, a lower edge and a back portion and is sized, shaped and disposed to receive the removable shoe weight.

An upper receiving notch is located at the upper edge of the cavity and a latch is located adjacent to the lower edge of the cavity. The latch comprises a resilient, elongated member located roughly parallel to the back portion of the cavity and a projecting finger extending at a right angle from the elongated member adjacent to the cavity.

A projecting lip is formed at the top edge of the weight. The lip is sized, shaped and located to engage the upper receiving notch. A receiving tab is fixedly attached to the bottom edge of the weight. The tab includes an orifice sized, shaped and located to removably engage the projecting finger of the latch.

In use, the projecting lip is inserted into the upper receiving notch, and the weight is tilted downwardly toward the athletic shoe. The elongated member of the latch is pulled outwardly from the athletic shoe and the weight is pressed into the cavity. The elongated member is released to allow the projecting finger to engage the orifice in the receiving tab. Thus, the weight is removably attached to the athletic shoe.

In a further variation, an athletic shoe having an upper portion and a resilient sole portion is provided. The upper portion has a forefoot enclosing section and a heel-enclosing section. The heel-enclosing section has a first side and a second side. The sole portion has a predetermined thickness, a forward end, an after end and a bottom surface.

The sole portion includes a heel weight cavity that has an opening at the after end of the sole portion and extends forwardly for a first predetermined distance. The cavity has an upper surface, a lower surface and a front surface.

A weight is provided that has a forward end, a rearward end, a top surface and a bottom surface. The weight is shaped to fit slidably within the cavity. Means are provided for ejecting the weight from the cavity as are means for releasably retaining the weight within the cavity.

In this variation, a plurality of weights of varying heaviness, formed to fit slidably within the heel weight cavity of the athletic shoe, are also provided.

In another variation of the invention the means for ejecting the weight from the heel weight cavity comprises a first compression spring secured to the front surface of the weight cavity and disposed between the cavity and the weight.

In still another variation, the means for releasably retaining the weight within the heel weight cavity comprises a detent opening positioned in the upper surface of the weight cavity at a right angle to the upper surface and a latch fixedly attached to the top surface of the weight. The latch is positioned adjacent to the rearward end of the weight. The latch includes a resilient, elongated member projecting upwardly from the top surface of the weight at an acute angle and a projecting finger extending at a right angle from the member. The finger is sized, shaped and located to releasably engage the detent opening of the cavity.

In use, the weight is inserted into the weight cavity, thereby compressing the first compression spring. The elongated member is pressed downwardly toward the upper surface of the weight. The elongated member is then released, thereby permitting the elongated member to spring upwardly and the projecting finger to engage the detent opening in the weight cavity. Thus removably retaining the weight within the weight cavity of the athletic shoe. To remove the weight from the cavity the elongated member is pressed downwardly against the weight, thereby disengaging the projecting finger of the latch from the detent opening. The first compression spring will then urge the weight outwardly from the cavity, allowing the wearer of the shoe to remove the weight.

In yet a further variation of the invention, a variable weight athletic shoe may be constructed comprising an athletic shoe having an upper portion and a resilient sole portion. The upper portion has a forefoot enclosing section and a heel-enclosing section. The sole portion has a predetermined thickness, a forward end, an after end, a central arch section and a bottom surface.

The arch section is located between the forward end and the after end of the sole portion and has a first side and a second side. The arch section includes an arch weight cavity that has an opening at the first side of the sole portion and extends toward the second side for a second predetermined distance. The cavity has an upper surface, a lower surface and a distal end surface.

A weight, having a forward end, a rearward end, a top surface and a bottom surface is provided. The weight is shaped to fit slidably within the cavity. Means are provided for ejecting the weight from the cavity and for releasably retaining the weight within the cavity.

In this variation a plurality of weights of varying heaviness, formed to fit slidably within the arch cavity of the athletic shoe, are provided.

In still another variation of the invention the means for ejecting the weight from the arch weight cavity comprises a second compression spring secured to the distal end surface of the weight cavity and disposed between the cavity and the weight.

In yet a further variation, the means for releasably retaining the weight within the arch weight cavity comprises a detent opening positioned in the upper surface of the weight cavity at a right angle to the upper surface of the cavity and a latch fixedly attached to the top surface of the weight. The latch is attached adjacent to the rearward end of the weight. The latch includes a resilient, elongated member projecting upwardly from the top surface of the weight at an acute angle and a projecting finger extending at a right angle from the member. The finger is sized, shaped and located to releasably engage the detent opening of the cavity.

In use, the weight is inserted into the weight cavity, thereby compressing the second compression spring. The elongated member is pressed downwardly toward the top surface of the weight, and the elongated member is then released. This permits the elongated member to spring upwardly and the projecting finger to engage the detent opening in the weight cavity thus removably retaining the weight within the weight cavity of the athletic shoe.

When the elongated member is pressed downwardly against the weight, thereby disengaging the projecting finger of the latch from the detent opening, the second compression spring will urge the weight outwardly from the cavity, allowing the wearer of the shoe to remove the weight from the cavity.

In still a further variation of the invention the means for removably attaching the weight to the after end of the sole portion further comprises first and second L-shaped alignment rails. The alignment rails are located on the after end of the sole portion adjacent its top edge. A cavity is provided. The cavity has an upper edge, a lower edge and a back wall and is centrally located between the first and second L-shaped alignment rails on the after end of the sole portion. The cavity is spaced from the bottom surface of the sole portion.

A latching member is provided. The latching member includes a vertical portion that has first end and a second end. The first end is pivotally attached to the lower edge of the cavity. A projecting finger element is fixedly attached to the second end of the latching member and extends outwardly from the cavity.

A third compression spring is located between the back wall of the cavity and the latching member and urges the latching member outwardly from the cavity. First and second access opening are provided. The access openings are sized, shaped and located on the inner surface of the removable shoe weight to receive the first and second L-shaped alignment rails.

First and second L-shaped alignment slots are provided. The alignment slots extend from the first and second access openings to the top edge of the weight. The alignment slots are sized, shaped and located to slidably receive the L-shaped alignment rails.

A receiving notch is provided. The receiving notch is sized shaped and located adjacent to the bottom edge of the weight to removably engage the projecting finger element of the latching member. In use, the first and second access openings in the inner surface of the shoe weight are located over the first and second L-shaped alignment rails. The weight is urged downwardly so that the first and second alignment rails will engage the first and second alignment slots. The latching member is urged inwardly against the coil spring, thereby permitting the receiving notch to pass the projecting finger element of the latching member. When the latching member is released the projecting finger element engages the receiving notch in the weight, thereby removably attaching the weight to the athletic shoe.

When the latching member is urged inwardly against the coil spring and the weight pulled upwardly from the athletic shoe the projecting finger element will disengage from the receiving notch. The weight will then slide upwardly permitting the first and second L-shaped alignment rails to enter the first and second access openings, thus permitting the weight to be pulled outwardly and removed from the after end of the sole portion of the athletic shoe.

In still another variation a plurality of weights of varying heaviness, formed to attach to the after end of the sole portion of the athletic shoe, are provided.

In a yet a further variation, the weights are encased in a covering material selected to protect the weight from corrosive forces and enhance the appearance of the shoe.

In still another variation of the invention, the means for removably attaching the weight to the after end of the sole portion further comprises first and second L-shaped brackets located on the first and second sides of the heel-enclosing section. Each of the L-shaped brackets is spaced a third predetermined distance from the bottom surface of the sole portion.

A weight is provided that includes a first weight portion, a second weight portion and a cam-lock lever. The cam-lock lever has a first end, a second end, a top surface and a bottom surface. The first weight portion has a first end and a second end. A first hooking element sized and shaped to removably engage the first L-shaped bracket is provided. The first hooking element is located at the first end of the first weight portion.

A plurality of adjustment notches located adjacent the second end of the first weight portion are provided. The second weight portion has a first end and a second end. A second hooking element sized and shaped to removably engage the second L-shaped bracket is provided. The second hooking element is located at the second end of the second weight portion.

A pivot pin is located adjacent the first end of the second weight portion. A relief depression sized and shaped to accept the bottom surface of the cam-lock lever and spaced from the first end of the second weight portion is provided. The cam-lock lever is pivotally attached at the first end to the pivot pin of the second weight portion. A notch engaging pall sized, shaped and located to engage the plurality of adjustment notches on the first weight portion is provided. The pall is pivotally mounted between the first end and the second end of the cam-lock lever.

An opening is located between the first end of the cam-lock lever and the pivotal mounting of the notch-engaging pall. The opening is sized and shaped to permit the second end and plurality of adjustment notches of the first weight portion to pass slidably through it. An operating handle is located at the second end of the cam-lock lever.

In operation the second end of the first weight portion is inserted through the opening in the cam-lock lever and the cam-lock lever is moved to a first, open position with the operating handle. The first hooking element is then located over the first L-shaped bracket and the second hooking element is located over the second L-shaped bracket. The pall then engages one of the adjusting notches on the first weight portion and the cam-lock lever is moved to a second, closed position. The bottom surface of the cam-lock lever is now located in the relief depression of the second weight portion and the first and second weight portions of the weight will be removably attached to the after end of the sole portion of the athletic shoe.

When the operating handle is moved to locate the cam-lock lever to the first, open position the first and second hooking elements will disengage the first and second L-shaped brackets and the weight may be removed from the athletic shoe.

Still another variation further comprises a plurality of weights of varying heaviness formed to attach to the after end of the sole portion of the athletic shoe.

Yet a further variation of the invention comprises an athletic shoe having an upper portion and a resilient sole portion. The upper portion of the athletic shoe has a forefoot-enclosing section and a heel-enclosing section. The forefoot enclosing section has a first side and a second side and includes at least one pair of first and second L-shaped brackets disposed on the first and second sides.

A weight is provided that includes a first weight portion, a second weight portion and a cam-lock lever. The cam-lock lever has a first end, a second end, a top surface and a bottom surface. The first weight portion has a first end and a second end. A first hooking element sized and shaped to removably engage the first L-shaped bracket is provided. The first hooking element is located at the first end of the first weight portion.

A plurality of adjustment notches located adjacent the second end of the first weight portion are provided. The second weight portion has a first end and a second end. A second hooking element sized and shaped to removably engage the second L-shaped bracket is provided. The second hooking element is located at the second end of the second weight portion.

A pivot pin is located adjacent the first end of the second weight portion. A relief depression sized and shaped to accept the bottom surface of the cam-lock lever and spaced from the first end of the second weight portion is provided. The cam-lock lever is pivotally attached at the first end to the pivot pin of the second weight portion. A notch engaging pall sized, shaped and located to engage the plurality of adjustment notches on the first weight portion is provided. The pall is pivotally mounted between the first end and the second end of the cam-lock lever.

An opening is located between the first end of the cam-lock lever and the pivotal mounting of the notch-engaging pall. The opening is sized and shaped to permit the second end and plurality of adjustment notches of the first weight portion to pass slidably through it. An operating handle is located at the second end of the cam-lock lever.

In operation the second end of the first weight portion is inserted through the opening in the cam-lock lever and the cam-lock lever is moved to a first, open position with the operating handle. The first hooking element is then located over the first L-shaped bracket and the second hooking element is located over the second L-shaped bracket. The pall then engages one of the adjusting notches on the first weight portion and the cam-lock lever is moved to a second, closed position. The bottom surface of the cam-lock lever is now located in the relief depression of the second weight portion and the first and second weight portions of the weight will be removably attached to the forefoot-enclosing section of the athletic shoe.

When the operating lever is moved to locate the cam-lock lever to the first, open position the first and second hooking elements will disengage the first and second L-shaped brackets and the weight may be removed from the athletic shoe.

Still another variation further comprises a plurality of weights of varying heaviness formed to attach to the forefoot-enclosing section of the athletic shoe.

DESCRIPTION OF THE DRAWINGS

FIG. 11 is a perspective view of the FIG. 9 embodiment with holes provided for lighter weight;

FIG. 12 is a partial break-away side elevational view of a fourth embodiment of a removable shoe weight, employing the first latching mechanism, attached to the arch of an athletic shoe;

FIG. 13 is a cross-sectional side elevational view of the FIG. 12 embodiment taken along the line 13—13.

FIG. 14 is a cross-sectional side elevation of a fifth embodiment of a removable shoe weight, employing a third latching mechanism, attached to the after end of the sole portion of an athletic shoe;

FIG. 15 is a perspective view of the FIG. 14 embodiment illustrating the latching mechanism, alignment rails and inner surface features of the shoe weight;

FIG. 16 is a rear elevational view of a sixth embodiment of a removable shoe weight, illustrating a cam-lock latching mechanism attached to the after end of the sole portion of an athletic shoe;

FIG. 17 is a plan view of the FIG. 16 embodiment illustrating the cam-lock latching mechanism in a closed position;

FIG. 18 is a plan view of the FIG. 16 embodiment illustrating the cam-lock latching mechanism in an open position; and FIG. 19 is a perspective view of the FIG. 16 shoe weight attached to the forefoot enclosing section of the athletic shoe.

DETAILED DESCRIPTION OF THE PREFERRED EMBODIMENT

Figure 1:
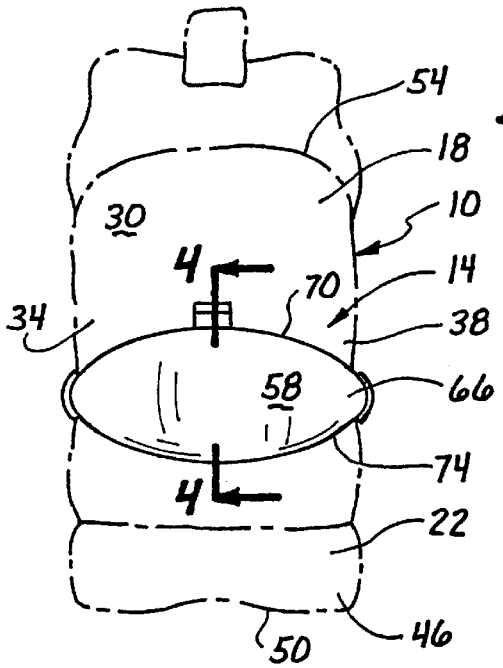
FIG. 1 is a front elevation of a first embodiment of a removable shoe weight, employing a first latching mechanism, attached to the after end of the sole portion of an athletic shoe.

As illustrated in FIGS. 1–19, a variable weight athletic shoe 10 may be constructed from the following components. As illustrated in FIGS. 1 and 3, an athletic shoe 14 having an upper portion 18 and a resilient sole portion 22 is provided. The upper portion 18 has a forefoot enclosing section 26 and a heel-enclosing section 30. The heel-enclosing section 30 has a first side 34 and a second side 38. The sole portion 22 has a forward end 42, an after end 46 and a bottom surface 50. The after end 46 extends upwardly from the bottom surface 50 to a top edge 54 and upon the heel-enclosing section 30 of the upper portion 18.

As illustrated in FIGS. 1–5, a removable shoe weight 58 is provided. The weight is formed of a resilient material and is shaped to conform to the after end 46 on the sole portion 22. The weight 58 has an inner surface 62, an outer surface 66, a top edge 70 and a bottom edge 74. Means 78 are provided for removably attaching the weight 58 to the after end 46 of the sole portion 22.

Figure 4:
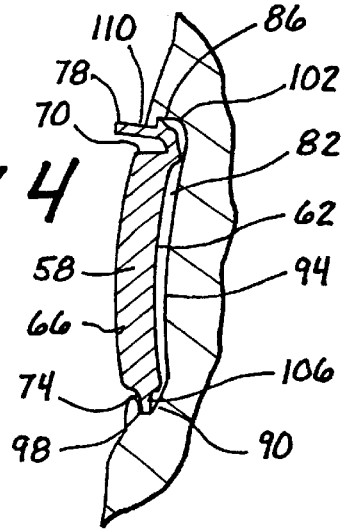
FIG. 4 is a cross-sectional side elevation of the FIG. 1 embodiment taken along the line 4—4.

In a variation of the invention, as illustrated in FIG. 4, the means 78 for removably attaching the weight 58 to the after end 46 of the sole portion 22 further comprises a cavity 82 located between the bottom surface 50 and the top edge 54 of the after end 46 of the sole portion 22 of the athletic shoe 14. The cavity 82 has an upper edge 86, a lower edge 90 and a back portion 94 and is sized, shaped and disposed to receive the removable shoe weight 58.

A lower receiving notch 98 located at the lower edge 90 of the cavity 82 and an upper receiving notch 102 located at the upper edge 86 of the cavity 82 are provided. A projecting tab 106 is fixedly attached to the bottom edge 74 of the weight 58. The tab 106 is sized, shaped and located to removably engage the lower receiving notch 98 of the cavity 82.

Figure 2:
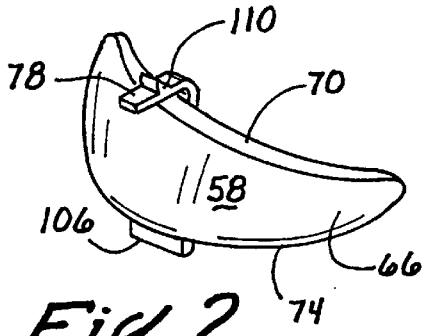
FIG. 2 is a perspective view of the FIG. 1 embodiment illustrating a first embodiment of a weight-retaining clip.
Figure 3:
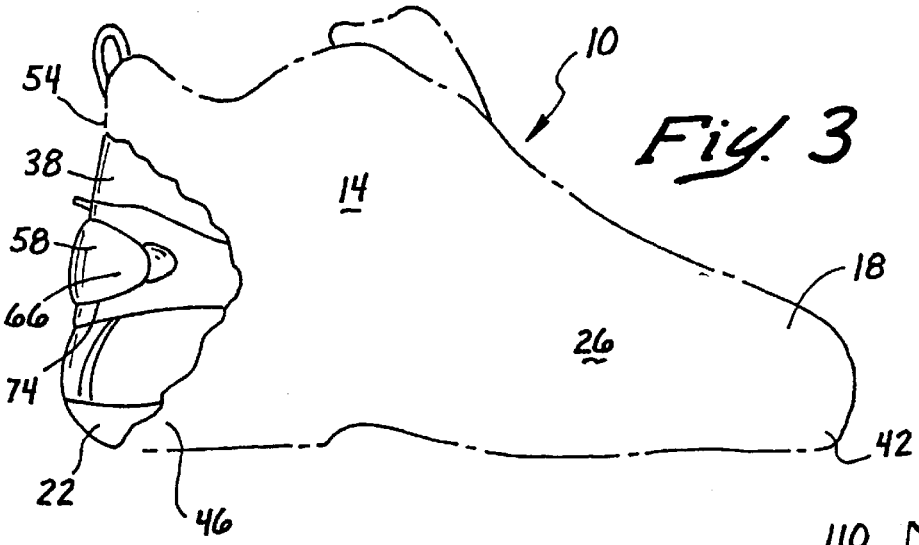
FIG. 3 is a side elevation of the FIG. 1 embodiment attached to the athletic shoe.
Figure 5:
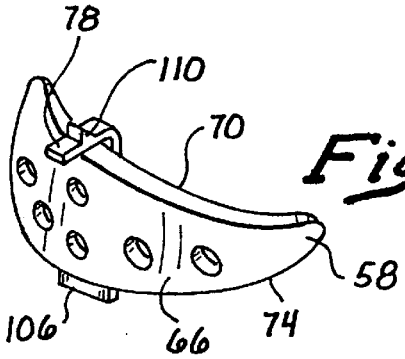
FIG. 5 is a perspective view of the FIG. 1 embodiment with holes provided for lighter weight.

As shown in FIGS. 2, 4 and 5, a resilient latch 110 is fixedly attached to the top edge 70 of the weight 58. The latch 110 is sized, shaped and located to releasably engage the upper receiving notch 102 of the cavity 82. In use, the projecting tab 106 is inserted into the lower receiving notch 98 and the weight 58 is tilted upwardly toward the athletic shoe 14. The resilient latch 110 is pressed downwardly toward the projecting tab 106, and the weight 58 is pressed into the cavity 82. The resilient latch 110 is released to engage the upper receiving notch 102. Thus the weight 58 is removably attached to the athletic shoe 14.

In another variation of the invention, illustrated in FIG. 5, a plurality of weights 58 of varying heaviness, formed to attach to the cavity 82 of the athletic shoe 14, are provided. In still another variation, the weights 58 are encased in a covering material selected to protect the weight from corrosive forces and enhance the appearance of the shoe 14.

Figure 6:
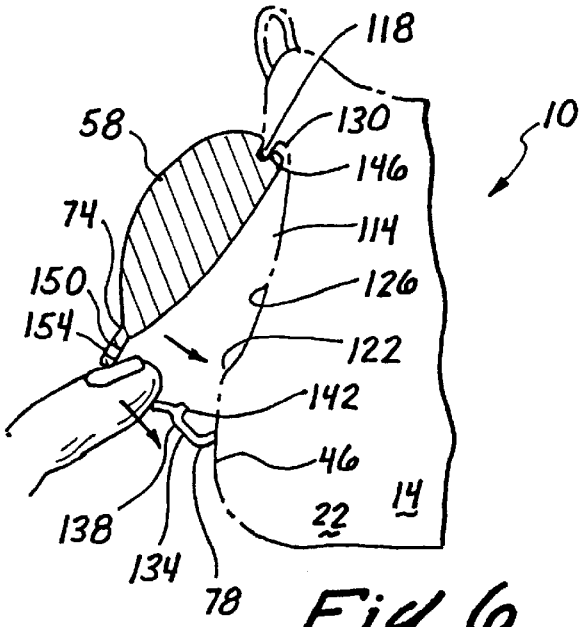
FIG. 6 is a cross-sectional side elevation of a second embodiment of a removable shoe weight, employing a second latching mechanism, attached to the after end of the sole portion of an athletic shoe.
Figure 7:
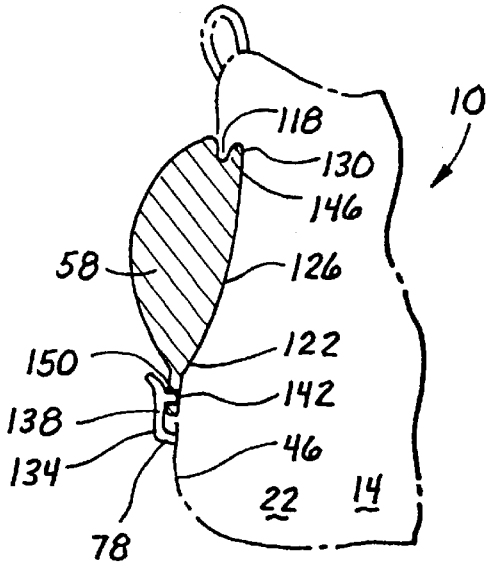
FIG. 7 is a cross-sectional side elevation of the second embodiment of a removable shoe weight inserted into a cavity in the heel portion of an athletic shoe.
Figure 8:
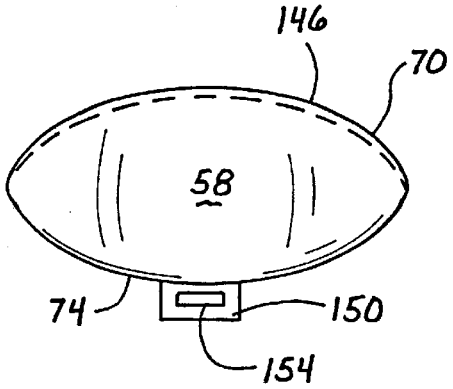
FIG. 8 is a rear elevational view of the FIG. 7 embodiment of the removable shoe weight illustrating the receiving tab and orifice.

In yet another variation of the invention, illustrated in FIGS. 6–8, the means 78 for removably attaching the weight 58 to the after end 46 of the sole portion 22 further comprises a cavity 114 located between the bottom surface 50 and the top edge 54 of the after end 46 of the sole portion 22 of the athletic shoe 14. The cavity 114 has an upper edge 118, a lower edge 122 and a back portion 126 and is sized, shaped and disposed to receive the removable shoe weight 58.

An upper receiving notch 130 is located at the upper edge 118 of the cavity 114 and a latch 134 is located adjacent to the lower edge 122 of the cavity 114. The latch 134 comprises a resilient, elongated member 138 located roughly parallel to the back portion 126 of the cavity 114 and a projecting finger 142 extending at a right angle from the elongated member 138 adjacent to the cavity 114.

A projecting lip 146 is formed at the top edge 70 of the weight 58. The lip 146 is sized, shaped and located to engage the upper receiving notch 130. A receiving tab 150 is fixedly attached to the bottom edge 74 of the weight 58. The tab 150 includes an orifice 154 sized, shaped and located to removably engage the projecting finger 142 of the latch 134.

In use, the projecting lip 146 is inserted into the upper receiving notch 130, and the weight 58 is tilted downwardly toward the athletic shoe 14. The elongated member 138 of the latch 134 is pulled outwardly from the athletic shoe 14 and the weight 58 is pressed into the cavity 114. The elongated member 138 is released to allow the projecting finger 142 to engage the orifice 154 in the receiving tab 150. Thus, the weight 58 is removably attached to the athletic shoe 14.

In a further variation, as illustrated in FIGS. 3 and 9–11 an athletic shoe 14 having an upper portion 18 and a resilient sole portion 22 is provided. The upper portion 18 has a forefoot enclosing section 26 and a heel-enclosing section 30. The heel-enclosing section 30 has a first side 34 and a second side 38. The sole portion 22 has a predetermined thickness 158, and a forward end 42, an after end 46 and a bottom surface 50.

The sole portion 22 includes a heel weight cavity 162 that has an opening 166 at the after end 46 of the sole portion 22 and extends forwardly for a first predetermined distance 170. The cavity 162 has an upper surface 174, a lower surface 178 and a front surface 182.

A weight 186 is provided that has a forward end 190, a rearward end 194, a top surface 198 and a bottom surface 202. The weight 186 is shaped to fit slidably within the cavity 162. Means 206 are provided for ejecting the weight 186 from the cavity 162 as are means 210 for releasably retaining the weight 186 within the cavity 162.

In this variation, as illustrated in FIG. 11, a plurality of weights 186 of varying heaviness, formed to fit slidably within the heel weight cavity 162 of the athletic shoe 14, are also provided.

Figure 9:
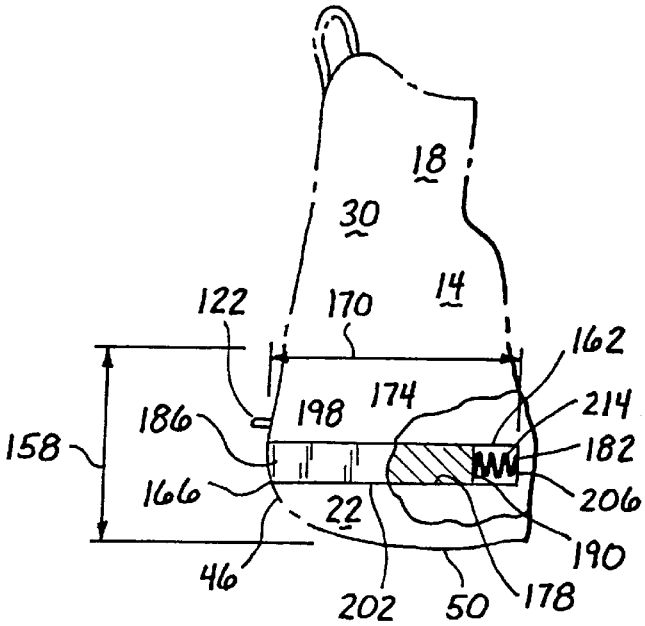
FIG. 9 is a partial break-away side elevational view of a third embodiment of a removable shoe weight installed in the heel of an athletic shoe.
Figure 10:
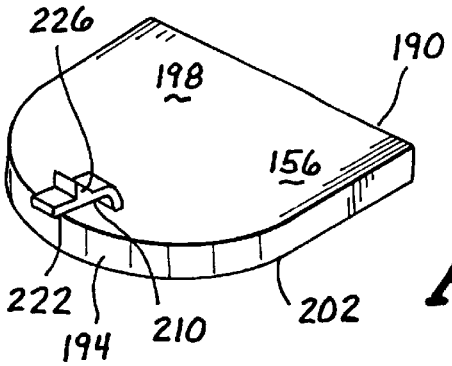
FIG. 10 is a perspective view of the FIG. 9 embodiment illustrating the latching mechanism.

In another variation of the invention, as illustrated in FIGS. 9–11, the means 206 for ejecting the weight 186 from the heel weight cavity 162 comprises a first compression spring 214 secured to the front surface 182 of the weight cavity 162 and disposed between the cavity 162 and the weight 186.

In still another variation, as illustrated in FIGS. 9–11, the means 210 for releasably retaining the weight 186 within the heel weight cavity 162 comprises a detent opening (not shown) positioned in the upper surface 174 of the weight cavity 162 at a right angle to the upper surface 174 and a latch 218 fixedly attached to the top surface 198 of the weight 186. The latch 218 is positioned adjacent to the rearward end 194 of the weight 186. The latch 218 includes a resilient, elongated member 222 projecting upwardly from the top surface 198 of the weight 186 at an acute angle and a projecting finger 226 extending at a right angle from the elongated member 222. The finger 226 is sized, shaped and located to releasably engage the detent opening of the cavity 162.

In use, the weight 186 is inserted into the weight cavity 162, thereby compressing the first compression spring 214. The elongated member 222 is pressed downwardly toward the upper surface 198 of the weight 186. The elongated member 222 is then released, thereby permitting the elongated member 222 to spring upwardly and the projecting finger 226 to engage the detent opening in the weight cavity 162. Thus removably retaining the weight 186 within the weight cavity 162 of the athletic shoe 14. To remove the weight 186 from the cavity 162 the elongated member 222 is pressed downwardly against the weight 186, thereby disengaging the projecting finger 226 of the latch 218 from the detent opening. The first compression spring 214 will then urge the weight 186 outwardly from the cavity 162, allowing the wearer of the shoe 14 to remove the weight 186.

In yet a further variation of the invention, illustrated in FIGS. 12 and 13, a variable weight athletic shoe 10 may be constructed comprising an athletic shoe 14 having an upper portion 18 and a resilient sole portion 22. The upper portion 18 has a forefoot enclosing section 26 and a heel-enclosing section 30. The sole portion 22 has a predetermined thickness 158, and a forward end 42, an after end 46, a central arch section 230 and a bottom surface 50.

The arch section 230 is located between the forward end 42 and the after end 46 of the sole portion 22 and has a first side 234 and a second side (not shown). The arch section 230 includes an arch weight cavity 242 that has an opening 246 at the first side 234 of the sole portion 22 and extends toward the second side for a second predetermined distance 250. The cavity 242 has an upper surface 254, a lower surface 258 and a distal end surface 262.

A weight 266, having a forward end 270, a rearward end 274, a top surface 278 and a bottom surface 282 is provided. The weight 266 is shaped to fit slidably within the cavity 242. Means 286 for ejecting the weight 266 from the cavity 242 and means 290 for releasably retaining the weight 266 within the cavity 242 are provided.

In this variation a plurality of weights 266 of varying heaviness, formed to fit slidably within the arch cavity 242 of the athletic shoe 14, are provided.

In still another variation of the invention the means 286 for ejecting the weight 266 from the arch weight cavity 242 comprises a second compression spring 294 secured to the distal end surface 262 of the weight cavity 242 and disposed between the cavity 242 and the weight 266.

In yet a further variation, the means 290 for releasably retaining the weight 266 within the arch weight cavity 242 comprises a detent opening 298 positioned in the upper surface 254 of the weight cavity 242 at a right angle to the upper surface 254 of the cavity 242 and a latch 302 fixedly attached to the top surface 278 of the weight 266. The latch 302 is attached adjacent to the rearward end 274 of the weight 266. The latch 302 includes a resilient, elongated member 306 projecting upwardly from the top surface 278 of the weight 266 at an acute angle and a projecting finger 310 extending at a right angle from the elongated member 306. The finger 310 is sized, shaped and located to releasably engage the detent opening 298 of the cavity 242.

In use, the weight 266 is inserted into the weight cavity 242, thereby compressing the second compression spring 294. The elongated member 306 is pressed downwardly toward the top surface 278 of the weight 266, and the elongated member 306 is then released. This permits the elongated member 306 to spring upwardly and the projecting finger 310 to engage the detent opening 298 in the weight cavity 242 thus removably retaining the weight 266 within the weight cavity 242 of the athletic shoe 14.

When the elongated member 306 is pressed downwardly against the weight 266, thereby disengaging the projecting finger 310 of the latch 302 from the detent opening 298, the second compression spring 294 will urge the weight 266 outwardly from the cavity 242, allowing the wearer of the shoe 14 to remove the weight 266 from the cavity 242.

In still a further variation of the invention, illustrated in FIGS. 14 and 15, the means 314 for removably attaching the weight 378 to the after end 46 of the sole portion 22 further comprises first 322 and second 326 L-shaped alignment rails. The alignment rails 322, 326 are located on the after end 46 of the sole portion 22 adjacent its top edge 54. A cavity 330 is provided. The cavity 330 has an upper edge 334, a lower edge 338 and a back wall 342 and is centrally located between the first 322 and second 326 L-shaped alignment rails on the after end 46 of the sole portion 22. The cavity 330 is spaced from the bottom surface 50 of the sole portion 22.

A latching member 346 is provided. The latching member 346 includes a vertical portion 350 that has first end 354 and a second end 358. The first end 354 is pivotally attached to the lower edge 338 of the cavity 330. A projecting finger element 362 is fixedly attached to the second end 358 of the latching member 346 and extends outwardly from the cavity 330. A third compression spring 368 is located between the back wall 342 of the cavity 330 and the latching member 346 and urges the latching member 346 outwardly from the cavity 330.

First 366 and second 370 access opening are provided. The access 366, 370 openings are sized, shaped and located on the inner surface 374 of the removable shoe weight 378 to receive the first 322 and second 326 L-shaped alignment rails.

First 382 and second 386 L-shaped alignment slots are provided. The alignment slots 382, 386 extend from the first 366 and second 370 access openings to the top edge 390 of the weight 378. The alignment slots 382, 386 are sized, shaped and located to slidably receive the L-shaped alignment rails 322, 326.

A receiving notch 394 is provided. The receiving notch 394 is sized shaped and located adjacent to the bottom edge 398 of the weight 378 to removably engage the projecting finger element 362 of the latching member 346. In use, the first 366 and second 370 access openings in the inner surface 374 of the shoe weight 378 are located over the first 322 and second 326 L-shaped alignment rails. The weight 378 is urged downwardly so that the first 322 and second 326 alignment rails will engage the first 382 and second 386 alignment slots. The latching member 346 is urged inwardly against the coil spring 366, thereby permitting the receiving notch 394 to pass the projecting finger element 362 of the latching member 346. When the latching member 346 is released the projecting finger element 362 engages the receiving notch 394 in the weight 378, thereby removably attaching the weight 378 to the athletic shoe 14.

When the latching member 346 is urged inwardly against the coil spring 366 and the weight 378 pulled upwardly from the athletic shoe 14 the projecting finger element 362 will disengage from the receiving notch 394. The weight 378 will then slide upwardly permitting the first 322 and second 326 L-shaped alignment rails to enter the first 366 and second 370 access openings, thus permitting the weight 378 to be pulled outwardly and removed from the after end 46 of the sole portion 22 of the athletic shoe 14.

In still another variation a plurality of weights 378 of varying heaviness, formed to attach to the after end 46 of the sole portion 22 of the athletic shoe 14, are provided.

In a yet a further variation, the weights 378 are encased in a covering material selected to protect the weight 378 from corrosive forces and enhance the appearance of the shoe 14.

In still another variation of the invention, illustrated in FIGS. 16–18 the means 398 for removably attaching the weight 402 to the after end 46 of the sole portion 22 further comprises first 406 and second 410 L-shaped brackets located on the first 34 and second 38 sides of the heel-enclosing section 30. Each of the L-shaped brackets 406, 410 is spaced a third predetermined distance 414 from the bottom surface 50 of the sole portion 22.

The weight 402 includes a first weight portion 422, a second weight portion 426 and a cam-lock lever 430. The cam-lock lever 430 has a first end 434, a second end 438, a top surface 442 and a bottom surface 446. The first weight portion 422 has a first end 450 and a second end 454. A first hooking element 458 sized and shaped to removably engage the first 406 L-shaped bracket is provided. The first hooking element 458 is located at the first end 450 of the first weight portion 422.

A plurality of adjustment notches 462 located adjacent the second end 454 of the first weight portion 422 are provided. The second weight portion 426 has a first end 466 and a second end 470. A second hooking element 474 sized and shaped to removably engage the second L-shaped bracket 410 is provided. The second hooking element 474 is located at the second end 470 of the second weight portion 426.

A pivot pin 478 is located adjacent the first end 466 of the second weight portion 426. A relief depression 482 sized and shaped to accept the bottom surface 446 of the cam-lock lever 430 and spaced from the first end 446 of the second weight portion 426 is provided. The cam-lock lever 430 is pivotally attached at the first end 434 to the pivot pin 478 of the second weight portion 426. A notch-engaging pall 482 sized, shaped and located to engage the plurality of adjustment notches 462 on the first weight portion 422 is provided. The pall 482 is pivotally mounted between the first end 434 and the second end 438 of the cam-lock lever 430.

An opening 486 is located between the first end 434 of the cam-lock lever 430 and the pivotal mounting 490 of the notch-engaging pall 482. The opening 486 is sized and shaped to permit the second end 454 and plurality of adjustment notches 462 of the first weight portion 422 to pass slidably through it. An operating handle 494 is located at the second end 438 of the cam-lock lever 430.

In operation the second end 454 of the first weight portion 422 is inserted through the opening 486 in the cam-lock lever 430 and the cam-lock lever 430 is moved to a first, open position (FIG. 18) with the operating handle 494. The first hooking element 458 is then located over the first L-shaped bracket 406 and the second hooking element 474 is located over the second L-shaped bracket 410. The pall 482 then engages one of the adjusting notches 462 on the first weight portion 422 and the cam-lock lever 430 is moved to a second, closed position (FIGS. 16 and 17). The bottom surface 446 of the cam-lock lever 430 is now located in the relief depression 482 of the second weight portion 426 and the first 422 and second 426 weight portions of the weight 402 will be removably attached to the after end 46 of the sole portion 22 of the athletic shoe 14.

When the operating handle 494 is moved to locate the cam-lock lever 430 to the first, open position the first 458 and second 474 hooking elements will disengage the first 406 and second 410 L-shaped brackets and the weight 402 may be removed from the athletic shoe 14.

Still another variation further comprises a plurality of weights 402 of varying heaviness formed to attach to the after end 46 of the sole portion of the athletic shoe.

Yet a further variation of the invention, illustrated in FIG. 19, comprises an athletic shoe 14 having an upper portion 18 and a resilient sole portion 22. The upper portion 18 of the athletic shoe 14 has a forefoot-enclosing section 26 and a heel-enclosing section 30. The forefoot enclosing section 26 has a first side 498 and a second side 502 and includes at least one pair of first 506 and second (not shown) L-shaped brackets disposed on the first 498 and second 502 sides.

The FIG. 16 embodiment of the removable shoe weight 402 may be attached to the first 506 and second (not shown) L-shaped brackets disposed on the first 498 and second 502 sides of the forefoot-enclosing section 26 of the upper portion 18 of the athletic shoe 14 in the manner previously described and illustrated for FIGS. 16–18.

A final variation of the invention further comprises a plurality of weights 402 of varying heaviness formed to attach to the forefoot-enclosing section of the athletic shoe 14.

The variable weight athletic shoe 10 has been described with reference to particular embodiments. Other modifications and enhancements can be made without departing from the spirit and scope of the claims that follow.

What is claimed is:

1. A variable weight athletic shoe, comprising:

an athletic shoe having an upper portion and a resilient sole portion;

said upper portion having a forefoot-enclosing section and a heel-enclosing section;

said heel-enclosing section having a first side and a second side;

said sole portion having a forward end, an after end and a bottom surface;

said after end having a first side and a second side and extending upwardly from the bottom surface to a top edge and being disposed upon the heel-enclosing section of the upper portion;

a removable shoe weight formed of a resilient material and being shaped to conform to the after end on the sole portion, said weight having an inner surface, an outer surface, a top edge and a bottom edge; and means for removably attaching the weight to the after end of the sole portion.

2. A variable weight athletic shoe as described in claim 1, wherein the means for removably attaching the weight to the after end of the sole portion further comprises:

a cavity disposed between the bottom surface and the top edge of the after end of the sole portion of the athletic shoe, said cavity having an upper edge, a lower edge and a back portion and being sized, shaped and disposed to receive the removable shoe weight;

a lower receiving notch disposed at the lower edge of the cavity;

an upper receiving notch disposed at the upper edge of the cavity;

a projecting tab fixedly attached to the bottom edge of the weight, said tab sized, shaped and disposed to removably engage the lower receiving notch of the cavity;

a resilient latch fixedly attached to the top edge of the weight, said latch sized, shaped and disposed to releasably engage the upper receiving notch of the cavity; and whereby, when the projecting tab is inserted into the lower receiving notch, and the weight is tilted upwardly toward the athletic shoe, and the resilient latch is pressed downwardly toward the projecting tab, and the weight is pressed into the cavity, and the resilient latch is released to engage the upper receiving notch, the weight will be removably attached to the athletic shoe.

3. A variable weight athletic shoe as described in claim 2, further comprising a plurality of weights of varying heaviness formed to attach to the cavity of the athletic shoe.

4. A variable weight athletic shoe as described in claim 3, wherein the weights are encased in a covering material selected to protect the weight from corrosive forces and enhance the appearance of the shoe.

5. A variable weight athletic shoe as described in claim 1, wherein the means for removably attaching the weight to the after end of the sole portion further comprises:

a cavity disposed between the bottom surface and the top edge of the after end of the sole portion of the athletic shoe, said cavity having an upper edge, a lower edge and a back portion and being sized, shaped and disposed to receive the removable shoe weight;

an upper receiving notch disposed at the upper edge of the cavity;

a latch disposed adjacent the lower edge of the cavity, said latch comprising a resilient, elongated member disposed roughly parallel to the back portion of the cavity and a projecting finger extending orthogonally from the elongated member adjacent the cavity;

a projecting lip formed at the top edge of the weight, said lip being sized, shaped and disposed to engage the upper receiving notch;

a receiving tab fixedly attached to the bottom edge of the weight, said tab including an orifice, said orifice being sized, shaped and disposed to removably engage the projecting finger of the latch; and whereby, when the projecting lip is inserted into the upper receiving notch, and the weight is tilted downwardly toward the athletic shoe, and the elongated member of the latch is pulled outwardly from the athletic shoe, and the weight is pressed into the cavity, and the elongated member is released to allow the projecting finger to engage the orifice in the receiving tab, the weight will be removably attached to the athletic shoe.

6. A variable weight athletic shoe as described in claim 1, wherein the means for removably attaching the weight to the after end of the sole portion further comprises:

first and second L-shaped alignment rails, said alignment rails disposed upon the after end of the sole portion adjacent the top edge;

a cavity, said cavity having an upper edge, a lower edge and a back wall and being disposed between the first and second L-shaped alignment rails on the after end of the sole portion and spaced from the bottom surface thereof;

a latching member, said latching member including a vertical portion having first end and a second end;

said first end being pivotally attached to the lower edge of the cavity;

a projecting finger element, said finger element fixedly attached to the second end of the latching member and extending outwardly from the cavity;

a third compression spring, said spring disposed between the back wall of the cavity and the latching member and urging the latching member outwardly from the cavity;

first and second access opening, said access openings sized, shaped and disposed upon the inner surface of the removable shoe weight to receive the first and second L-shaped alignment rails;

first and second L-shaped alignment slots, said alignment slots extending from the first and second access openings to the top edge of the weight;

said alignment slots sized, shaped and disposed to slidably receive the L-shaped alignment rails;

a receiving notch, said receiving notch sized shaped and disposed adjacent the bottom edge of the weight to removably engage the projecting finger element of the latching member;

whereby, when the first and second access openings in the inner surface of the shoe weight are disposed over the first and second L-shaped alignment rails, and the weight is urged downwardly so that the first and second alignment rails will engage the first and second alignment slots and when the latching member is urged inwardly against the coil spring, thereby permitting the receiving notch to pass the projecting finger element of the latching member and when the latching member is released the projecting finger element will engage the receiving notch in the weight, thereby removably attaching the weight to the athletic shoe; and whereby, when the latching member is urged inwardly against the coil spring and the weight pulled upwardly from the athletic shoe the projecting finger element will disengage from the receiving notch and the weight will slide upwardly permitting the first and second L-shaped alignment rails to enter the first and second access openings, thus permitting the weight to be pulled outwardly and removed from the after end of the sole portion of the athletic shoe.

7. A variable weight athletic shoe as described in claim 6, further comprising a plurality of weights of varying heaviness formed to attach to the after end of the sole portion of the athletic shoe.

8. A variable weight athletic shoe as described in claim 7, wherein the weights are encased in a covering material selected to protect the weight from corrosive forces and enhance the appearance of the shoe.

9. A variable weight athletic shoe as described in claim 1, wherein the means for removably attaching the weight to the after end of the sole portion further comprises:

first and second L-shaped brackets disposed upon the first and second sides of the heel-enclosing section;

each of said L-shaped brackets spaced a third predetermined distance from the bottom surface of the sole portion;

a weight including a first weight portion, a second weight portion and a cam-lock lever, having a first end, a second end, a top surface and a bottom surface;

said first weight portion having a first end and a second end;

a first hooking element sized and shaped to removably engage said first L-shaped bracket, said first hooking element disposed at the first end of the first weight portion;

a plurality of adjustment notches, said adjustment notches disposed adjacent the second end of the first weight portion;

said second weight portion having a first end and a second end;

a second hooking element sized and shaped to removably engage said second L-shaped bracket, said second hooking element disposed at the second end of the second weight portion;

a pivot pin disposed adjacent the first end of the second weight portion;

a relief depression, said depression being sized and shaped to accept the bottom surface of the cam-lock lever and spaced from the first end of the second weight portion;

said cam-lock lever being pivotally attached at said first end to the pivot pin of the second weight portion;

a notch engaging pall, said pall being sized, shaped and disposed to engage the plurality of adjustment notches on the first weight portion;

said pall being pivotally mounted between the first end and the second end of the cam-lock lever;

an opening disposed between the first end of the cam-lock lever and the pivotal mounting of the notch engaging pall, said opening being sized and shaped to permit the second end and plurality of adjustment notches of the first weight portion to pass slidably therethrough;

an operating handle disposed at the second end of the cam-lock lever;

whereby, when the second end of the first weight portion is inserted through the opening in the cam-lock lever, and the cam-lock lever is moved to a first, open position with the operating handle, and the first hooking element is disposed over the first L-shaped bracket, and the second hooking element is disposed over the second L-shaped bracket, and the pall engages one of the adjusting notches on the first weight portion, and the cam-lock lever is moved to a second, closed position so that the bottom surface of the cam-lock lever is disposed in the relief depression of the second weight portion, the first and second weight portions of the weight will be removably attached to the after end of the sole portion of the athletic shoe; and whereby, when the operating handle is moved to dispose the cam-lock lever to the first, open position the first and second hooking elements will disengage the first and second L-shaped brackets and the weight may be removed from the athletic shoe.

10. A variable weight athletic shoe as described in claim 9, further comprising a plurality of weights of varying heaviness formed to attach to the after end of the sole portion of the athletic shoe.

11. A variable weight athletic shoe, comprising:

an athletic shoe having an upper portion and a resilient sole portion;

said upper portion having a forefoot enclosing section and a heel-enclosing section;

said heel-enclosing section having a first side and a second side;

said sole portion having a predetermined thickness, a forward end, an after end and a bottom surface;

said sole portion including a heel weight cavity having an opening at the after end of the sole portion and extending forwardly for a first predetermined distance;

said cavity having an upper surface, a lower surface and a front surface;

a weight, having a forward end, a rearward end, a top surface and a bottom surface and being shaped to fit slidably within said cavity;

means for ejecting the weight from the cavity; and means for releasably retaining the weight within the cavity said means being formed as a portion of the weight.

12. A variable weight athletic shoe as described in claim 11, further comprising a plurality of weights of varying heaviness formed to fit slidably within the heel weight cavity of the athletic shoe.

13. A variable weight athletic shoe as described in claim 11 wherein the means for ejecting the weight from the heel weight cavity comprises a first compression spring secured to the front surface of the weight cavity and disposed between the cavity and the weight.

14. A variable weight athletic shoe as described in claim 13 wherein the means for releasably retaining the weight within the heel weight cavity comprises:

a detent opening positioned in the upper surface of the weight cavity orthogonal thereto;

a latch fixedly attached to the top surface of the weight adjacent the rearward end thereof, said latch including a resilient, elongated member projecting upwardly from said top surface at an acute angle and a projecting finger extending orthogonally from said elongated member, said finger being sized, shaped and disposed to releasably engage the detent opening of the cavity;

whereby, when the weight is inserted into the weight cavity, thereby compressing the first compression spring, and the elongated member is pressed downwardly toward the upper surface of the weight, and the elongated member is then released, thereby permitting the elongated member to spring upwardly and the projecting finger to engage the detent opening in the weight cavity thus removably retaining the weight within the weight cavity of the athletic shoe; and whereby, when the elongated member is pressed downwardly against the weight, thereby disengaging the projecting finger of the latch from the detent opening, the first compression spring will urge the weight outwardly from the cavity, allowing the wearer of the shoe to remove the weight from the cavity.

15. A variable weight athletic shoe, comprising:

an athletic shoe having an upper portion and a resilient sole portion;

said upper portion having a forefoot enclosing section and a heel-enclosing section;

said sole portion having a predetermined thickness and a forward end, an after end, a central arch section and a bottom surface;

said arch section being disposed between the forward end and the after end of the sole portion and having a first side and a second side;

said arch section including an arch weight cavity having an opening at the first side of the sole portion and extending toward the second side for a second predetermined distance;

said cavity having an upper surface, a lower surface and a distal end surface;

a weight, having a forward end, a rearward end, a top surface and a bottom surface and being shaped to fit slidably within said cavity;

means for ejecting the weight from the cavity; and means for releasably retaining the weight within the cavity said means being formed as a portion of the weight.

16. A variable weight athletic shoe as described in claim 15, further comprising a plurality of weights of varying heaviness formed to fit slidably within the arch cavity of the athletic shoe.

17. A variable weight athletic shoe as described in claim 15 wherein the means for ejecting the weight from the arch weight cavity comprises a second compression spring secured to the distal end surface of the weight cavity and disposed between the cavity and the weight.

18. A variable weight athletic shoe as described in claim 15 wherein the means for releasably retaining the weight within the arch weight cavity comprises:

a detent opening positioned in the upper surface of the weight cavity orthogonal thereto;

a latch fixedly attached to the top surface of the weight adjacent the rearward end thereof, said latch including a resilient, elongated member projecting upwardly from said top surface at an acute angle and a projecting finger extending orthogonally from said member, said finger being sized, shaped and disposed to releasably engage the detent opening of the cavity;

whereby, when the weight is inserted into the weight cavity, thereby compressing the second compression spring, and the elongated member is pressed downwardly toward the top surface of the weight, and the elongated member is then released, thereby permitting the elongated member to spring upwardly and the projecting finger to engage the detent opening in the weight cavity thus removably retaining the weight within the weight cavity of the athletic shoe; and whereby, when the elongated member is pressed downwardly against the weight, thereby disengaging the projecting finger of the latch from the detent opening, the second compression spring will urge the weight outwardly from the cavity, allowing the wearer of the shoe to remove the weight from the cavity.

* * * * *